US008696341B2

(12) United States Patent
Staehle et al.

(10) Patent No.: US 8,696,341 B2
(45) Date of Patent: Apr. 15, 2014

(54) DEVICE FOR PRODUCING CONCRETE BLOCKS

(75) Inventors: Manfred Staehle, Legau (DE); Hans Gebhart, Memmingen (DE)

(73) Assignee: Baustoffwerke Gebhart & Soehne GmbH & Co. KG, Lachen (DE)

( * ) Notice: Subject to any disclaimer, the term of this patent is extended or adjusted under 35 U.S.C. 154(b) by 511 days.

(21) Appl. No.: 12/866,438

(22) PCT Filed: Jan. 28, 2009

(86) PCT No.: PCT/EP2009/000520

§ 371 (c)(1),
(2), (4) Date: Dec. 21, 2010

(87) PCT Pub. No.: WO2009/097989

PCT Pub. Date: Aug. 13, 2009

(65) Prior Publication Data

US 2011/0115123 A1 May 19, 2011

(30) Foreign Application Priority Data

Feb. 7, 2008 (DE) ..... 10 2008 008 279

(51) Int. Cl.
*B28B 13/04* (2006.01)

(52) U.S. Cl.
USPC ..... 425/132; 425/133.1; 425/134; 425/145; 425/147; 425/256; 425/449; 425/451; 366/9; 366/193; 222/133; 222/135

(58) Field of Classification Search
CPC ..... B28B 13/0205; B28B 13/022; B28B 13/0225; B28C 5/04; B28C 7/0053
USPC ..... 425/63–65, 130, 132, 133.1, 134, 145, 425/147, 256–257, 260, 262, 421, 445–449, 425/451, 462; 264/73–74, 245, 247, 256, 264/333; 366/9, 183.1, 192, 193; 222/133–137
See application file for complete search history.

(56) References Cited

U.S. PATENT DOCUMENTS

| | | | | | |
|---|---|---|---|---|---|
| 3,076,229 | A | * | 2/1963 | Arpajian | 425/448 |
| 3,955,907 | A | * | 5/1976 | Yamasita et al. | 425/130 |
| 4,178,340 | A | * | 12/1979 | Hyytinen | 264/73 |
| 4,358,205 | A | * | 11/1982 | Eakins | 366/141 |
| 4,500,273 | A | * | 2/1985 | Anderson | 425/143 |
| 4,624,195 | A | * | 11/1986 | Doering | 111/12 |

(Continued)

FOREIGN PATENT DOCUMENTS

| | | | | | |
|---|---|---|---|---|---|
| DE | 3208290 | A1 | * | 9/1983 | B28B 13/02 |
| EP | 1 017 554 | | | 12/1999 | |
| JP | 01192505 | A | * | 8/1989 | B28B 13/02 |
| JP | 09255082 | A | * | 9/1997 | B65D 88/52 |

*Primary Examiner* — Dimple Bodawala
(74) *Attorney, Agent, or Firm* — Paine Hamblen, LLP

(57) ABSTRACT

The invention relates to a device for producing concrete blocks, particularly paving stones, building blocks or the like, comprising a storage container forming a receiving chamber for a plurality of layers of concrete in different colors. Dispensing means are provided, in order to dispense partial amounts of the layers from the receiving chamber such that a release device connected downstream receives a mixture of the layers of concrete in different colors. At least a partial section of a side wall of the receiving chamber is provided with at least one dispensing opening for dispensing a partial amount of the layers. The size of the passage of the dispensing opening can be varied by the dispensing means.

5 Claims, 6 Drawing Sheets

(56) References Cited

U.S. PATENT DOCUMENTS

| | | | | |
|---|---|---|---|---|
| 6,461,552 | B1 | 10/2002 | Geiger | |
| 6,619,945 | B1 * | 9/2003 | Sims | 425/219 |
| 6,817,551 | B2 * | 11/2004 | Williams et al. | 239/656 |
| 2003/0198122 | A1 | 10/2003 | Johnson | |
| 2005/0238752 | A1 * | 10/2005 | Toncelli | 425/447 |
| 2005/0241916 | A1 * | 11/2005 | Gentili | 198/545 |
| 2009/0320762 | A1 * | 12/2009 | Chang | 119/53 |
| 2010/0319570 | A1 * | 12/2010 | Forbes et al. | 105/248 |

* cited by examiner

DEVICE FOR PRODUCING CONCRETE BLOCKS

The present invention relates to a device for producing concrete blocks.

The present invention also relates to a storage container with a receiving space for a plurality of layers of different-colored concrete for use in a device for producing concrete blocks as disclosed in further detail in the specification as provided, hereinafter.

The invention further relates to a method for producing concrete blocks as described in the specification as set forth hereinafter.

A device of the type in question and a method of the type in question are known from EP 1 017 554 B1.

Conventional methods for producing concrete blocks, in particular paving stones, building blocks or the like, provide in most cases a basic body which is formed from coarse concrete and is provided on the upper side with a solidly covering facing layer of colored concrete or concrete mortar. In this case, provision is made for the coarse concrete to be poured into a mold and compacted in the mold by shaking and/or pressing. This causes the coarse concrete to sink. In the lowered space of the mold, the colored concrete mortar is applied to the coarse concrete as a facing layer and compacted from a storage container which is also referred to as the facing container or facing silo.

It is known to use gravity to remove from the storage container dyed concrete or concrete mortar as a facing layer for concrete blocks. In the case of a multicolored facing layer, for example if a marbled facing layer or a color mix is to be achieved, concrete or mortar masses are introduced into the storage container, separately color by color, and supplied to the molds in blended or unblended form.

Furthermore, it is known to use for each colored concrete its own additional container from which the desired amount of concrete is dispensed in each case.

The described methods and devices have in common the drawback of high machine and production-related costs. In addition, many of the facing layers achieved display undefined color patterns as a result of disadvantageous blendings, for example as a consequence of heap formations.

A storage container forming a receiving space for a plurality of layers of different-colored concrete is known in the general art, the floor of the storage space being embodied as a slide. Once the storage space has been filled with the various layers of concrete, the slide is opened continuously or cyclically, so that gravity causes partial amounts or portions of the layers to fall downward and to be supplied to a downstream release device. The downstream release device can have a closure member which is embodied for controlling a quantitative, portionwise release of the colored concrete or concrete mortar and fills the molds. The configuration of the storage container with a slide causes only comparatively low machine costs and leads to improved through-mixing of the layers of different-colored concrete. Nevertheless, the blending of the layers of different-colored concrete is not yet sufficiently advantageous; further heaps are in particular formed. This applies in particular to the first partial amount that falls downward when the slide opens. In this partial amount, only slight or insufficient blending takes place.

In order to further improve the blending, the generic document, EP 1 017 554 B1, proposes combining the slide known from practical experience with impact bodies arranged in the path of movement of the partial portions of the concrete layers that move downward as a result of gravity. In this case, the partial portions of the concrete layers are intended to strike the impact bodies in such a way that the partial portions are guided onto a deflecting curve and blended with one another more effectively.

The solution known from EP 1 017 554 B1 further improves blending, but leads to higher machine and design costs. In addition, there is also the problem that in particular the first partial amount of concrete or concrete mortar that is let out through the slide displays a disadvantageous blending. The blending is improved only over the course of the further letting-out of partial portions of the layers. However, as the receiving space of the storage container has only a limited size, paving stones with a facing layer displaying a color blending which is different to, i.e. less advantageous than, the remainder of the batch are produced frequently, that is to say whenever the first partial amount is let out of the storage container.

The present invention is therefore based on the object of providing a device and a method for producing concrete blocks that allow a plurality of layers of different-colored concrete to be blended with one another in the desired manner and at low cost, in particular in order to produce facing layers having a defined, uniform appearance for concrete blocks.

With regard to the device, this object is achieved by claim 1.

An advantageous storage container for use in a device for producing concrete blocks emerges from the teachings of the present application as set forth in the Specification and claims which follow.

Additionally the methodology of the present invention will become apparent from a study of the Specification as provided hereafter.

A targeted and defined amount of concrete made up of different-colored layers may be let out of the receiving space of the storage container as a result of the fact that at least a partial portion of a side wall of the receiving space is provided with at least one dispensing opening for dispensing a partial amount of the layers, and the size of passage of the dispensing opening is variable by dispensing means.

For the purposes according to the invention, the term "concrete" refers equally to concrete mortar or mortar or another pourable material for producing blocks, in particular paving stones, building blocks and the like.

Because the at least one dispensing opening is arranged in the side wall, concrete made up of the different-colored layers can fall out of the receiving space of the storage container without the concrete falling—as was the case in the prior art—out of the storage container in the order in which the concrete is stored there layer by layer. The dispensing opening in the side wall can for example allow concrete made up of the different-colored layers to fall downward simultaneously. However, it is also possible for firstly the dispensing opening in the side wall, the dispensing opening being associated with the top layer, to be opened and subsequently—after a time delay—partial amounts of layers which are positioned deeper or positioned therebelow to be dispensed through the dispensing opening. It is thus possible for partial amounts of the various layers of colored concrete to arrive simultaneously at the end of their path of movement or flight and for a desired, for example uniform, blending to be set as a result. Temporally offset opening may be achieved for example by arranging the dispensing means obliquely to the dispensing opening or obliquely arranging the opening edge of the dispensing means.

In principle, the device according to the invention and the method according to the invention allow any desired blending to be set. What matters in this regard is that in particular the mixing ratio of the first partial amount of the concrete removed from the receiving space of the storage container is no longer dependent on the layer closest to the floor of the storage container first being let out.

According to the invention, provision may be made for the dispensing means to open and close the dispensing opening cyclically in order to dispense a partial amount of the layers during the opening cycle. As a result, it is possible to let out in each case a defined amount of concrete from the individual layers.

Furthermore, in a development of the invention, provision may be made for the side wall provided with the at least one dispensing opening to be inclined in relation to a vertical plane. The inclination of the side wall provided with the dispensing opening allows partial amounts of the different-colored layers of concrete to be dispensed particularly effectively and independently of the layer arranged in each case thereunder.

In principle, provision may also be made for merely the partial portion of a side wall in which the dispensing opening is arranged to be inclined.

Furthermore, provision may be made for a plurality of side walls or partial portions of a plurality of side walls to be provided with dispensing openings. In this case, one or more side walls can be accordingly inclined.

The inclination advantageously also allows, in the case of two layers positioned one on top of the other, in each case the upper layer adjoining the side wall to form an overhang protruding horizontally beyond the lower layer. Gravity can cause this overhang to fall downward, independently of the layer positioned thereunder, when the at least one dispensing opening is opened by the dispensing means. In addition, in an advantageous manner, the overhang can cause further concrete to slip down and fall through the dispensing opening. If appropriate, provision may be made for the dispensing means to open and subsequently reclose only for a defined time. During a further opening cycle, the concrete which has slipped down can thus be dispensed in a defined manner.

It is advantageous if the inclination of the side wall is variable.

A variation of the inclination may be advantageous, for example as a function of the composition of the concrete, for achieving a desired blending. An alteration of the inclination allows inter alia the visual effect of the concrete block to be varied, for example a marbling or a uniform blending to be achieved. Furthermore, provision may be made for the inclination to be varied as a function of the filling level, for example when a defined partial amount has already been released from the receiving space of the storage container.

The inclination of the side wall may for example be 5 to 70 degrees, preferably 5 to 35 degrees. These values have proven to be particularly suitable with regard to the desired uniform blending and also in consideration of the desired partial amount which is to be dispensed through the dispensing opening in the side wall.

As an alternative or in addition to the inclination of the side wall, provision may also be made for the receiving space or the storage container to be inclinable or pivotable or tiltable in the direction of the side wall provided with the at least one dispensing opening. This can be achieved for example by appropriate turning of the receiving space or rotation. Bearings and/or shafts/hinge pins and the like known to the person skilled in the art can be used for this purpose. In this case too, it may be advantageous if the inclination or the rotation of the receiving space in the direction of the side wall provided with the dispensing opening is variable. It is in this case also possible to incline or to rotate the receiving space sufficiently far in the direction of the side wall provided with the at least one dispensing opening for the side wall provided with the dispensing opening to form the floor of the receiving space. A visual strip effect, for example, may be achieved by using the solution according to the invention in this way.

According to the invention, provision may furthermore be made for the outer walls delimiting the receiving space (i.e. the side walls, the floor and if appropriate a cover) to form at least approximately a spherical shape or an arc of a circle shape. This is advantageous in particular when the receiving space is to be rotated or inclined in the direction of the side wall provided with the at least one dispensing opening. For this purpose, it is not absolutely essential for the entire receiving space to have a spherical shape; it is sufficient if the receiving space has at least approximately a spherical shape over the angular range over which the receiving space is to be inclined or rotated. The mechanical complexity, in particular the bearings for rotating the receiving space, is simplified as a result.

According to the invention, provision may furthermore be made for the side wall provided with the at least one dispensing opening and/or an opposing side wall to be movable in order to vary their distance from each other. As a result, it is if required possible to additionally supply concrete to the dispensing opening by reducing the distance between the side walls. Alternatively, a movable partition can also precede the opposing side wall. Furthermore, alternatively or additionally thereto, shaking or vibration may also be provided in order to supply, if appropriate, further material to the dispensing opening in the side wall.

It is advantageous if the at least one dispensing opening runs substantially horizontally or vertically in the side wall. A horizontal arrangement of the at least one dispensing opening allows a partial amount of concrete to be let out in a targeted manner from each layer of different-colored concrete. In a horizontal arrangement of the dispensing opening, it is advantageous if the side wall has a plurality of dispensing openings, so that a dispensing opening can be associated with each layer of multicolored concrete. It is in this case also conceivable for a respective horizontally running dispensing opening to be arranged at an interface between two layers, so that a partial amount of concrete can be let out from both layers by opening the dispensing opening.

Furthermore, it is advantageous if the side wall is provided with a plurality of dispensing openings running substantially parallel to one another. A uniform blending of the layers may thus be achieved irrespective of the course of the dispensing opening in the side wall.

According to the invention, provision may furthermore be made for the dispensing openings to form pockets, channels or guides through which gravity causes the layers to fall downward. A particularly advantageous configuration of the dispensing openings or the side wall provided therewith can consist in the side wall having two walls arranged at a distance, one after the other, the first wall facing the receiving space and being provided with the dispensing openings and the second wall guiding the concrete falling in through the dispensing opening. The wall facing the inner side of the receiving space can be provided between the dispensing openings with guide or stabilizing webs. These webs can if appropriate also be connected to the rear wall, so that channels or pockets are formed for guiding the concrete as it falls out. However, it is in this case advantageous if the pockets are not closed, but connected one over another by apertures in the stabilizing webs or the stabilizing webs extend only over a part of the height, so that the pockets do not obstruct, in particular do not clog, the falling-down of the concrete.

According to the invention, provision may be made for the dispensing means to be embodied as swords, drawing sheets, slides, hinges or the like. An embodiment of this type has proven advantageous in order to be able to rapidly and easily open and close the dispensing openings. However, in principle, the dispensing openings can be closed in any desired manner.

It is advantageous if the dispensing means are suitable for continuously varying the size of passage of the dispensing opening. This allows the partial amount to be dispensed from the layers of different-colored concrete to be advantageously controlled. However, in principle, it is also possible to configure the dispensing means in such a way that the dispensing means can perform merely a simple open/close operation.

It is furthermore advantageous if a dispensing means is associated with each dispensing opening. The dispensing means can in this case be controlled separately from or together with the other dispensing means. Separate controlling of the dispensing means allows, in particular in the case of a horizontal orientation of the dispensing openings in the side wall, only one layer and thus only one concrete color to be supplied, if appropriate in a targeted manner, to the subsequent release device.

In a preferable configuration of the invention, provision may be made for the dispensing means to be connected to one another and jointly movable. It is thus possible to open and to close a plurality of dispensing openings at the same time.

It is advantageous if the dispensing means are embodied as a connecting link having passage openings, the connecting link being adjustable or displaceable to the side wall provided with the dispensing openings in such a way that the size of passage of the outlet openings results from the overlap thereof with the passage openings of the connecting link. A displacement of the connecting link parallel to the side wall is particularly preferable. A configuration of the dispensing means as a connecting link allows a particularly simple actuation in order to open and to close the dispensing openings or in order to set different sizes of passage.

According to the invention, provision may furthermore be made for the dispensing means to be provided with projections, pins, springs or the like, which are oriented toward the layers, in order to loosen up the layers in the region of the dispensing means. This configuration is also particularly expedient when the dispensing means are embodied as a connecting link or in a connecting link. A displacement of the connecting link parallel to the side wall causes the projections, pins and the like to loosen up the concrete adjoining the connecting link, so that the concrete can advantageously fall through the dispensing openings.

In an alternative or additional configuration, provision may also be made for the dispensing means to be embodied as rotatable shafts, rollers or the like which vary the size of passage of the dispensing opening as a function of the rotation. Provision may in this case also be made for the shafts to have means in order to convey partial amounts of the layers through the dispensing opening. The means can in this case be configured for example as blades, projections, mandrels and the like, if appropriate similar to a water wheel or the vanes of a vane cell pump. Provision may also be made for two respective shafts to cooperate in mutual engagement.

In a design configuration of the invention, means can furthermore be provided in order to fill the receiving space with layers of the different-colored concrete, the layers being as uniform as possible. This can be carried out in various ways; particular preference is given to a configuration of the means as guide sheets which are arranged above the receiving space and ensure, as soon as the different-colored concrete is poured in, that substantially uniform layers are formed. The layers can in this case also have a differing thickness. This may for example be the case if the same amount of concrete for each layer is in each case poured in, but the areas of the layers are different on account of the inclination of the side wall. It is advantageous if the thickness of a layer is constant.

It is advantageous if the floor of the receiving space is embodied as a slide. Concrete which cannot be dispensed or is not intended to be dispensed through the output openings in the side wall can be removed through the slide. The removal is in this case carried out in such a way that the slide is slid into a position in which the slide releases an opening slot, so that gravity causes partial portions of the concrete contained in the receiving space to fall down.

It is advantageous if the slide is transversely movable, thus allowing the formation between side walls and the slide of a variable opening slot through which gravity causes partial portions of the layers to fall downward.

It is advantageous if the receiving space is formed in a substantially funnel-shaped manner and increases in size toward the top.

The solution according to the invention is particularly suitable also for retrofitting existing devices for producing concrete blocks, in particular paving stones. For this purpose, the storage container with the receiving space for a plurality of layers of different-colored concrete is integrated into the existing device for producing concrete blocks. This can be carried out in a simple manner in that the storage container having the features according to the invention is mounted above the existing storage container—which is frequently also referred to as the facing container. From the storage container having the features according to the invention, the concrete can then be dispensed into the existing storage or facing container or arrives there in the desired blended composition.

The side wall which is provided in accordance with the invention with the at least one dispensing opening does not necessarily have to be a side wall which is at the same time an outer wall of the receiving container or surrounds the outer circumference of the concrete which is introduced in the receiving space. It is also conceivable for the side wall to be an inner wall in the receiving space, the inner wall being embodied as a partition, for example. The partition may be accordingly inclined. The inner wall can be embodied in particular in a tower-shaped, dome-shaped or conical manner and arranged in the receiving space.

The side wall can be embodied (preferably also in an inclined manner) as any desired vertically running wall which is connected to the layers of different-colored concrete that are introduced in the receiving space, or can adjoin the different-colored layers of concrete.

In an advantageous method for producing concrete blocks, provision is in accordance with the invention made for at least a first partial amount of the layers to be dispensed from the storage container as a result of the fact that at least one dispensing opening is opened in at least a partial portion of a side wall of the receiving space. In this case, it is advantageous if the at least one dispensing opening in the side wall is opened in such a way that, from each layer of different-colored concrete, a substantially uniform or desired amount falls through the dispensing opening.

Furthermore, it is advantageous if the at least one dispensing opening opens in such a way that the opening extends substantially in the vertical direction in the side wall, so that, from each layer of different-colored concrete, a partial amount falls into the dispensing opening irrespective of the lower layer in any given case. In the method according to the invention, it is advantageous if the side wall provided with the at least one dispensing opening is inclined or can be inclined in such a way that, in the case of two layers positioned one on top of the other, in each case the upper layer adjoining the side wall forms an overhang protruding horizontally beyond the lower layer.

The further features described with regard to the device according to the invention can be used in a similar manner also as method steps.

Advantageous configurations and developments of the invention will emerge from the further dependent claims. The principle of exemplary embodiments of the invention will be illustrated hereinafter with reference to the drawings, in which:

Figure 6:
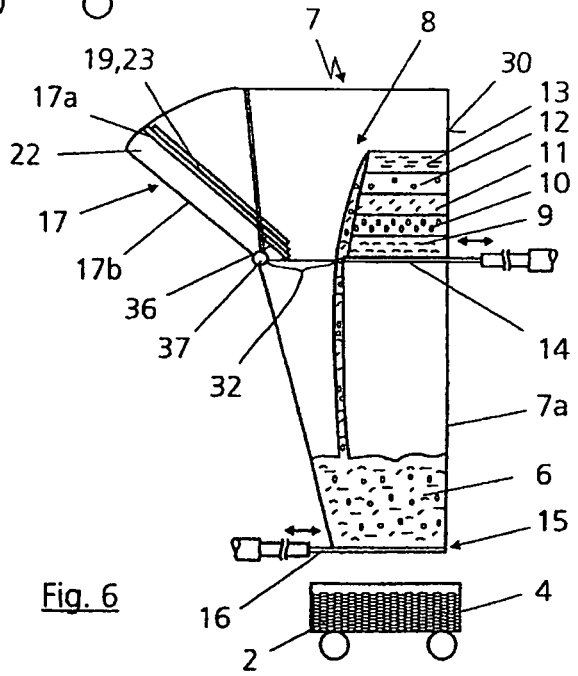
FIG. 6 is a further illustration according to FIG. 5, a floor of the receiving space being partly opened, the floor being embodied as a slide.
Figure 7A:
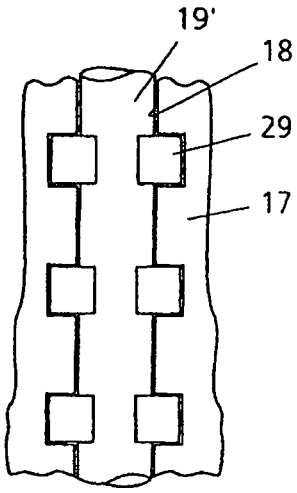
Figure 7B:
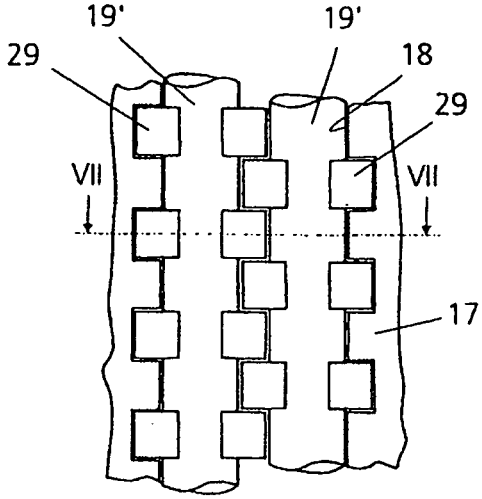
Figure 8A:
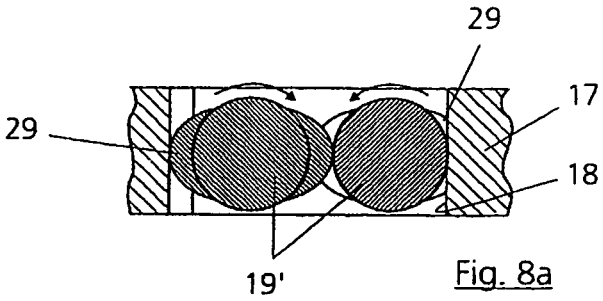
Figure 8B:
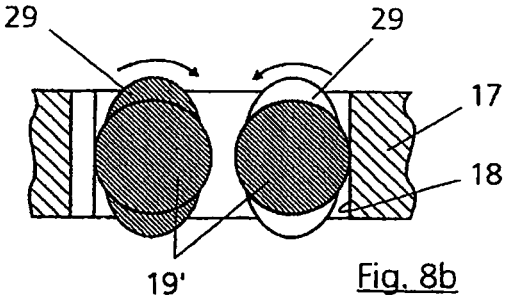
Figure 9:
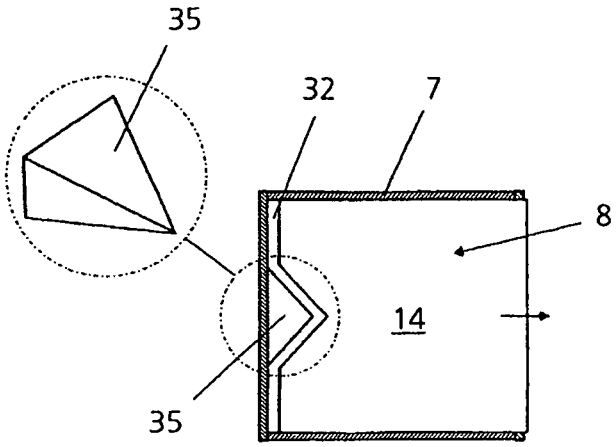
Figure 10:
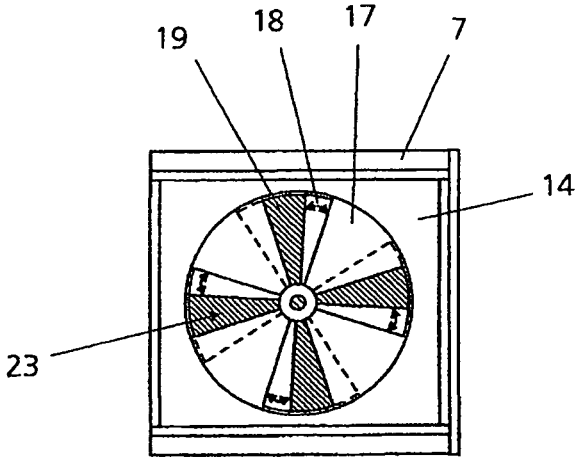

FIG. 7*a* shows a detail of a partial portion of a side wall provided with a dispensing opening, the dispensing means being embodied, for closing the dispensing opening, as a shaft;

FIG. 7*b* is an illustration according to FIG. 6*a*, the dispensing opening in the side wall being closed by two mutually engaging shafts;

FIG. 8*a* is a sectional illustration taken along the line VII-VII from FIG. 6*b*, the shafts engaging with each other in such a way that the dispensing opening is closed;

FIG. 8*b* is an illustration of the shafts according to FIG. 7*a*, the shafts being rotated in such a way that the dispensing opening is completely opened;

FIG. 9 is a principle-type plan view from above onto the floor of the receiving space, the floor being embodied as a slide, the slide having a triangular recess and an adjoining side wall being provided with a prismatic or semiconical projection interacting with the triangular recess of the slide; and FIG. 10 is a principle-type plan view onto an alternative embodiment of the side wall provided with the dispensing openings.

Devices and methods for producing concrete blocks, in particular paving stones, building blocks and the like, have long been known in the general art, so that only the features essential to the invention will be examined hereinafter in greater detail. In this regard, reference is made for example to EP 1 017 554 B1.

Figure 1:
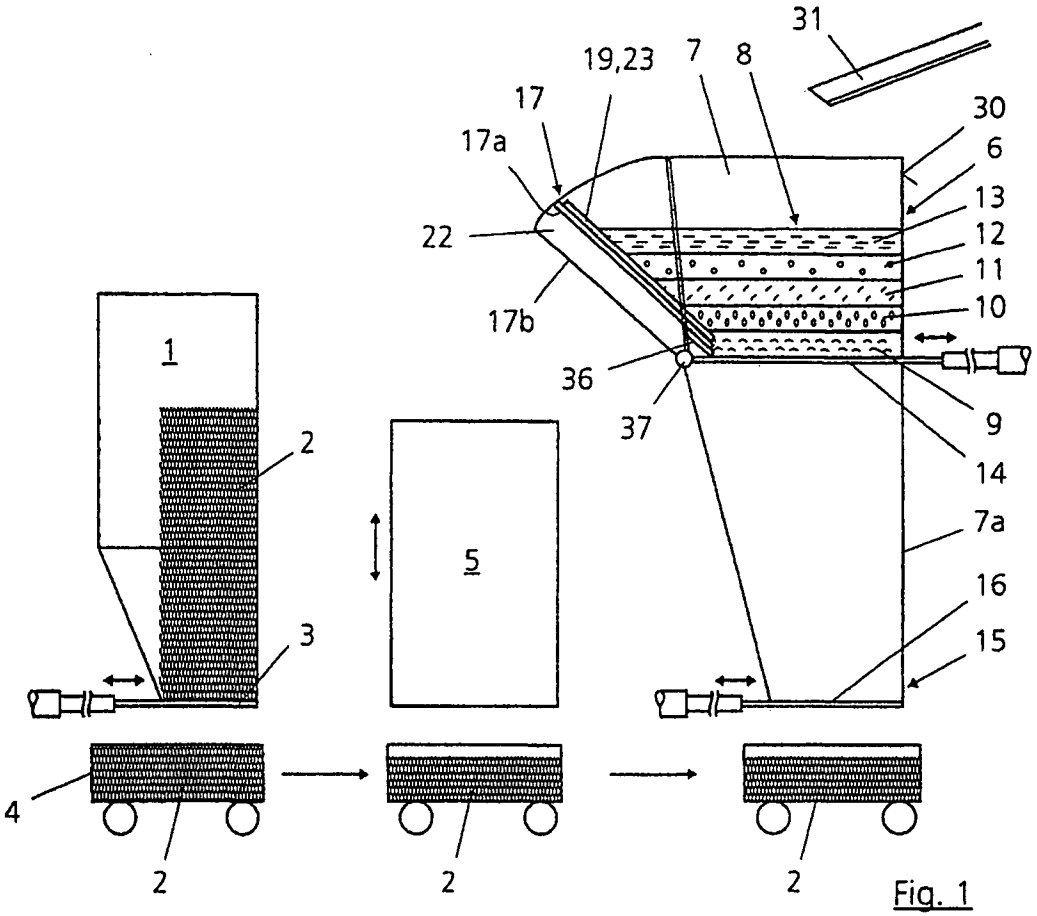
FIG. 1 is a side view illustrating the principle of a device for producing concrete blocks.

FIG. 1 shows a basic principle of the device according to the invention. In this case, a container 1 is provided and serves to receive coarse concrete 2 or no-fines concrete which can be released to a mold 4 arranged under the container 1 via a closure member 3.

Once it has been filled with coarse concrete 2, the mold 4 is supplied in a known manner to a shaking and/or pressing station 5. The coarse concrete 2 is compacted in the pressing station 5 as a result of the shaking and/or pressing. The space in the mold 4 that is in this case created above the compacted coarse concrete 2 serves to receive colored concrete 6 or concrete mortar. The concrete 6 or the concrete mortar is in this case also referred to as facing concrete or facing concrete mortar.

As may be seen from FIG. 1, the colored concrete 6 is stored in a storage container 7 in order to form the facing layer. In this case, provision is made for a plurality of layers 9, 10, 11, 12 and 13 of differently dyed concrete, which are jointly used to form facing layers for paving stones, to be stored in the storage container 7 or in a receiving space 8 of the storage container 7. The layers 9, 10, 11, 12 and 13 rest in this case, stored one over another, on a floor 14 of the receiving space 8. Below the floor 14 of the receiving space, the storage container 7 has a cylindrical or funnel-shaped extension 7*a* leading to a dispensing device 15 with a closure member 16. The closure member 16 closes the lower end of the storage container 7. The closure member 16 serves to control a quantitative, portionwise release of colored concrete mortar from the storage container 7 into the mold 4. The closure member 16 can in this case open and close the lower end of the storage container 7 in any desired manner, for example as a result of displacement or pivoting of the closure member.

In one configuration (not illustrated in greater detail), provision may also be made for the funnel-shaped extension 7*a*, illustrated in FIG. 1, of the storage container 7 to be a storage container which is independent of the storage container 7, in particular in the manner in which storage containers are used in conventional devices for producing concrete blocks. It is thus possible for the storage container 7 according to the invention to be able to be used for retrofitting pre-existing devices for producing concrete blocks. For this purpose, the storage container 7 according to the invention can be attached as an attachment to the upper end of the previous storage container 7 and be connected thereto. The solution according to the invention thus allows pre-existing devices for producing concrete blocks to be retrofitted or upgraded at comparatively low cost.

As may also be seen, in particular from FIGS. 1 to 6, one of the side walls 17 surrounding or forming and delimiting the receiving space 8 is provided with a plurality of dispensing openings 18. The dispensing opening 18 serves in this case to dispense a partial amount of the layers 9, 10, 11, 12 and 13, the size of passage of the dispensing openings 18 being variable by dispensing means 19.

The side wall 17 provided with the dispensing openings 18 is inclined in relation to a vertical plane. The inclination is in this case variable by an adjusting device 20 which is illustrated merely schematically in FIG. 2 and which may for example be a crank or an electric motor. In order to vary the inclination of the side wall 17, a guide device 21 is also provided that allows the inclination of the side wall 17 to be increased or reduced by actuating the adjusting device 20.

Figure 5:
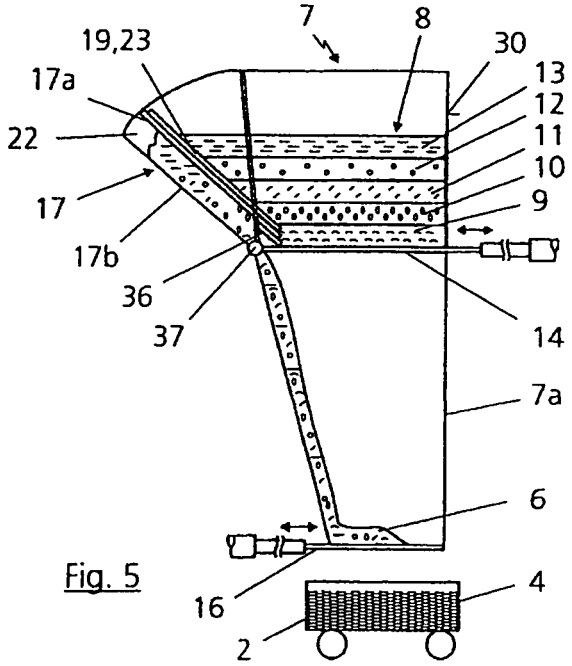
FIG. 5 is a principle-type sectional illustration of a device for dispensing different-colored concrete into a mold.

As may be seen in particular from FIGS. 1 and 5, the inclination allows, in the case of two layers 9, 10, 11, 12 and 13 positioned one on top of the other, in each case the upper layer adjoining the side wall 17 to form an overhang protruding horizontally beyond the lower layer.

The dispensing opening 18 is arranged in the side wall 17 in such a way that the dispensing opening reaches each layer 9, 10, 11, 12 and 13, irrespective of the inclination of the side wall 17, and allows concrete to fall out of each layer.

In the exemplary embodiment, provision is made for the dispensing openings 18 to run vertically or perpendicularly in the side wall 17 or to be made vertically in the side wall 17. In the exemplary embodiment, the dispensing openings 18 run in this case parallel to one another.

Figure 2:
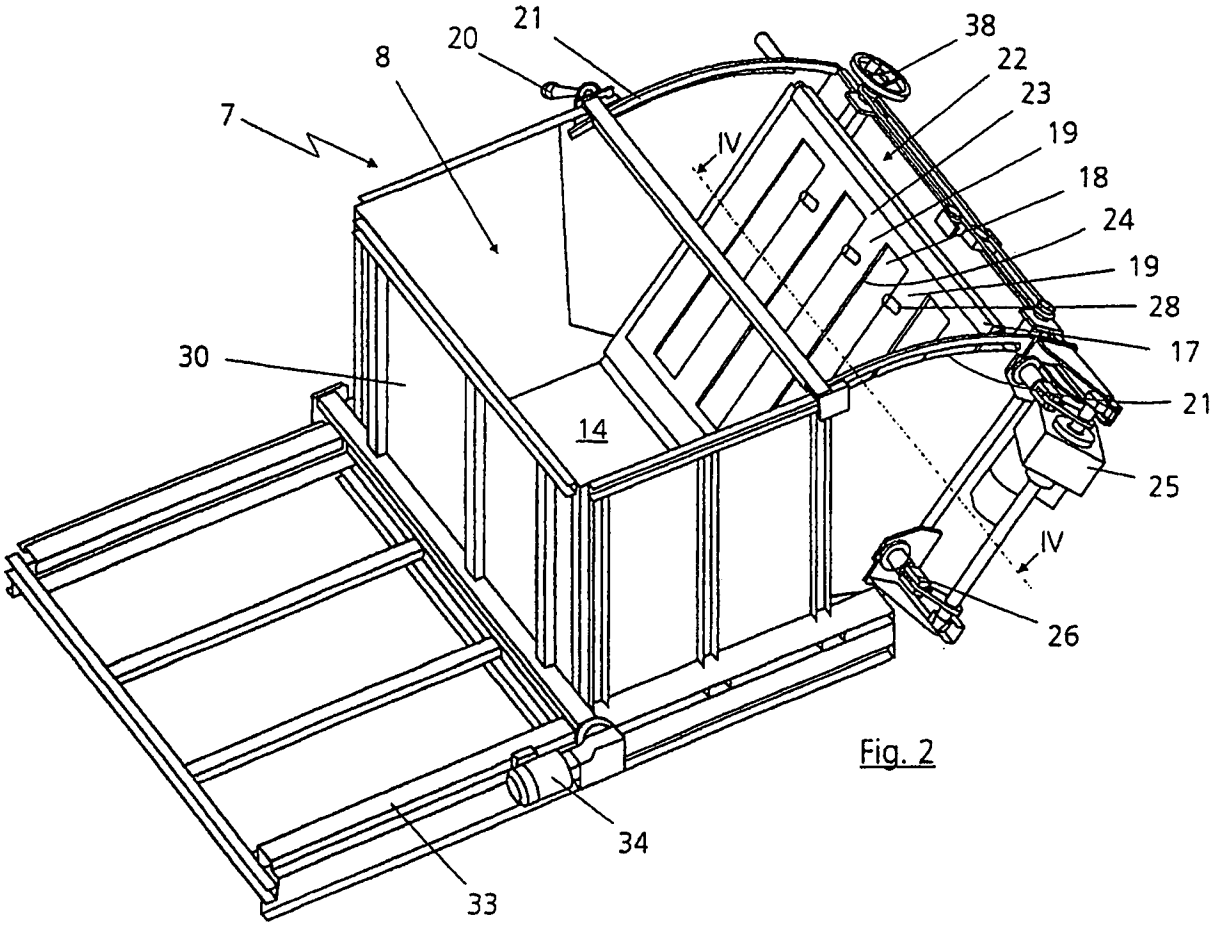
FIG. 2 is a principle-type, perspective view of a storage container according to the invention.
Figure 4:
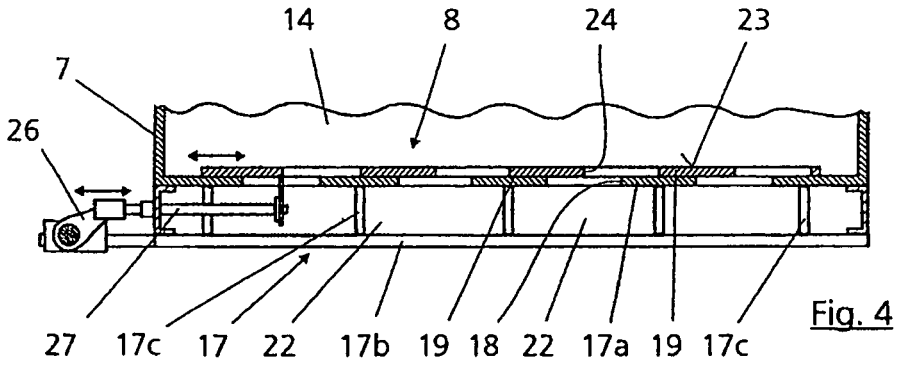
FIG. 4 is a view from above onto a side wall provided with a plurality of dispensing openings, wherein the dispensing openings can be opened and closed by a connecting link-type dispensing means arranged displaceably at the front of the side wall.

As may be seen in particular from FIGS. 1, 2 and 4 viewed in conjunction with one another, the side wall 17 is embodied in such a way as to produce pockets 22 which are filled by the dispensing openings 18 with partial amounts of concrete from the layers 9, 10, 11, 12 and 13. In these pockets 22, gravity can cause the concrete 6 to fall downward in the direction of the dispensing device 15 or the closure member 16.

The pockets 22 are formed in a simple manner in that the side wall 17 has two walls 17*a*, 17*b*. In this case, the wall 17*a* is the front of the side wall 17 and is oriented in the direction of the receiving space 8 which it adjoins. The wall 17*a* is provided with the dispensing openings 18. The wall 17*b*, which is preferably completely closed and thus, as a closed back wall, prevents the concrete 6 falling in through the dispensing openings 18 from escaping in an undesired direction, is located after the wall 17*a*, i.e. at the side remote from the receiving space 8. Stabilizing sheets 17*c* are arranged between the walls 17*a* and 17*b*. The stabilizing sheets 17*c* can extend over the entire height of the walls 17*a*, 17*b*. However, in an advantageous configuration, it is sufficient if the stabilizing sheets 17*c* extend only over a portion of the height or if appropriate a plurality of stabilizing sheets 17*c* are arranged one over another and next to one another.

The dispensing means 19 can be embodied in any desired manner, preferably as swords, drawing sheets, slides, hinges or the like. In the exemplary embodiment, provision is made for the dispensing means 19 to be embodied in a connecting link 23 having passage openings 24, the connecting link 23 being displaceable to the side wall 17 provided with the dispensing openings 18 in such a way that the size of passage of the outlet openings 18 results from the overlap thereof with the passage openings 24 of the connecting link 23.

In this configuration, the solid webs or swords between the passage openings 24 of the connecting link 23 are the dispensing means 19 which, in a corresponding position of the connecting link 23, completely close the dispensing openings 18 or ensure by way of a corresponding displacement that the dispensing openings 18 overlap with the passage openings 24 of the connecting link 23.

In the exemplary embodiment, the connecting link 23 is arranged before the wall 17*a* of the side wall 17, i.e. between the wall 17*a* and the receiving space 8. The connecting link 23 extends in this case so as to be substantially plane-parallel to the wall 17*a*. In principle, the connecting link 23 can also be arranged differently, for example at the back of the wall 17*a*, as a result of which the pressure of the concrete contained in the receiving space 8 does not obstruct, or obstructs to a lesser extent, a displacement of the connecting link 23 plane-parallel to the wall 17*a*. However, in the exemplary embodiment, provision is made for the connecting link 23 to be displaceably arranged at the front of the wall 17*a*. A displacement of the connecting link 23 varies the overlap between the dispensing openings 18 in the wall 17*a* or the side wall 17 and the passage openings 24 in the connecting link 23.

Figure 3:
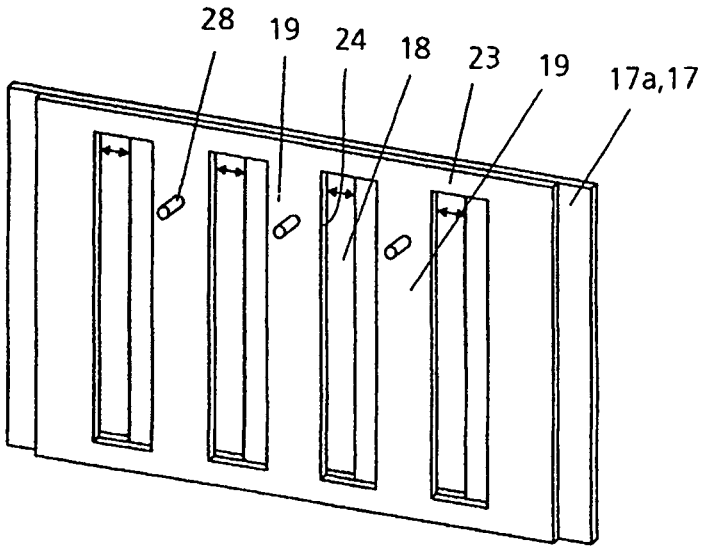
FIG. 3 is a plan view onto a side wall with dispensing openings and with dispensing means for opening and closing the dispensing openings.

FIG. 3 is a plan view onto the side of the connecting link 23 that faces the receiving space 8, the dispensing means 19, i.e. the webs between the passage openings 24 of the connecting link 23, partly concealing the dispensing openings 18.

The connecting link 23 can be moved in relation to the wall 17*a* in any desired manner; in the exemplary embodiment, an electric motor 25, which is illustrated in FIG. 2, is provided for this purpose. The sectional illustration according to FIG. 4 additionally shows an actuating lever 26, the extension 27 of which is connected to the connecting link 23 in such a way that the extension is movable plane-parallel to the wall 17*a*.

As may also be seen from FIG. 2 and FIG. 3, the dispensing means 19, i.e. the webs of the connecting link 23, are provided with pins 28, mandrels or the like, which are oriented toward the layers 9, 10, 11, 12 and 13, in order to loosen up the layers 9, 10, 11, 12 and 13 in the region of the dispensing means 19, so that the concrete 6 can fall through the dispensing openings 18 in loosened-up form and clumps are avoided. FIGS. 2 and 3 show just one row of pins. It is however advantageous if at least one pin 28 is arranged on each layer 9, 10, 11, 12 and 13 and for each dispensing opening 18.

FIGS. 7*a* and 7*b* show two alternatives for configuring the dispensing means 19. According to FIGS. 7*a* and 7*b*, the dispensing means are embodied as rotatable shafts 19' which vary the size of passage of the dispensing openings 18 as a function of rotation. FIGS. 7*a* and 7*b* show in this case merely a detail of the side wall 17 or the wall 17*a* with a dispensing opening 18 in which the rotatable shafts 19' are arranged. The shafts 19' have in this case means 29 for conveying partial amounts of the layers through the dispensing opening 18. In the exemplary embodiment, the means are embodied in this case as thickenings 29; however, the means could also be vanes, circumferential enlargements, projections, blades, pins and the like. The thickenings 29 are intended to allow, in addition to the independent falling-out of concrete 6 through the dispensing opening 18, active movement of the concrete 6 out of the receiving space 8, for example such as is the case during pumping.

FIG. 7*b* shows an arrangement of two respective shafts 19' for each dispensing opening 18 which cooperate in mutual engagement. In this case, FIG. 8*a* shows a position, such as it is illustrated in FIG. 7*b*, in which the shafts 19' engage with each other in such a way that the thickenings 29 completely or almost completely close the dispensing opening 18. FIG. 8*b* shows an arrangement of the shafts 19' that is rotated through 90 degrees, as a result of which the dispensing opening 18 has its maximum size of passage.

The shafts 19' can for example be formed from plastics material, rubber or metal.

In a manner not illustrated in greater detail, provision may be made for the side wall 17 provided with the dispensing openings 18 and/or an opposing side wall 30 to be movable in order to increase or reduce the distance between the side walls 17 and 30.

Furthermore, means 31, for example in the form of guide sheets, can be provided, as is illustrated by way of principle in FIG. 1, in order to fill the receiving space 8 with layers 9, 10, 11, 12 and 13 of the different-colored concrete, the layers being as uniform as possible. In the exemplary embodiment, the guide sheets 31 are arranged above the receiving space.

The receiving space 8 can have any desired configuration. For example, provision may be made for the size of the receiving space 8 to increase in a substantially funnel-shaped manner toward the top. The receiving space 8 can for example have a size of from 1 to 4 $m^3$, preferably 1 to 3 $m^3$.

As may also be seen from FIG. 2 as well as FIGS. 5 and 6, the floor 14 of the receiving space 8 is embodied as a slide or drawing sheet. In the exemplary embodiment, the slide 14 is mounted so as to be transversely displaceable, so that an opening slot 32 is formed between the slide 14 and the outer walls 17, 30 of the receiving space as a result of a longitudinal movement of the slide 14. Gravity can cause partial portions of the layers 9, 10, 11, 12 and 13 to fall downward through this opening slot 32. FIG. 5 is an illustration in which the slide 14 is closed, i.e. the floor in the receiving space 8 is closed. FIG. 6 is an illustration in which the opening slot 32 already takes up one third of the original floor, so that the partial portions or columns of the layers 9, 10, 11, 12 and 13 can collapse and blend in the process.

The slide 14 can open and close in any desired and known manner. In this regard and with respect to the general construction and the function of the slide 14, reference is made to the prior art, in particular EP 1 017 554 B1. If appropriate, an impact body, a prism or a guide sheet according to EP 1 017 554 B1 can also be provided in the falling path of the concrete from the slide 14 and/or the dispensing openings 18.

Conventionally, the slide is embodied as a flat or planar plate, made preferably of metal. FIG. 2 shows a possibility for displacing the slide 14. A carrier frame 33, which carries the storage container 7, is in this case provided. The carrier frame 33 is extended sufficiently far in a horizontal plane that the slide 14 can be displaced via an electric motor 34 in such a way that the opening slot 32 opens and closes.

In the exemplary embodiment, the slide 14 does not extend to under the pockets 22; in principle, the pockets are therefore open. However, in an alternative configuration, the pockets can also be closed by the slide 14 or a separate element.

FIG. 9 is a plan view from above onto the slide 14 in a specific configuration. The slide 14 has in this case a triangular incision which is closed, when the slide 14 is closed, by a prismatic or conical projection 35 which also extends upward. As a result of the conical projection 35, more material slips down, during opening of the slide 14, from upper layers 10, 11, 12 and 13 (on account of the rising slope of the conical projection 35) than would be the case in a conventional slide 14. This can be advantageous for certain applications.

Even independently of the solution according to the invention, a use of a slide according to FIG. 9 is expedient for certain applications, including for example in the device according to EP 1 017 554 B1.

FIG. 10 shows a further configuration of the solution according to the invention; in this case, provision is made for the side wall 17 provided with the dispensing openings 18 to be embodied as an inner wall in the receiving space 8. The side wall 17 is in this case conically configured and tapers from the floor 14 of the receiving space 8 toward the top. Provided, again, is a type of connecting link 23 having web-like dispensing means 19 and passage openings 24. In this configuration, the connecting link element 23 is adapted to the side wall 17 and therefore also configured in a conical or substantially conical manner. A rotation of the connecting link 23 to the side wall 17 or to the dispensing openings 18 thereof alters the overlap of the dispensing openings 18 with the passage openings 24, so that the size of passage of the dispensing openings 18 can be varied, if appropriate completely opened or completely closed.

The floor or the slide 14 can open in a known manner, wherein the conical inner or side wall 17 can be linked, as shown in FIG. 10, to outer side walls of the receiving space 8, for example via a carrier mount.

A further advantageous detail, in particular for the embodiments illustrated in FIGS. 1 to 8, is an extension sheet 36 which may be seen for example in FIGS. 2, 5 and 6. In order to be able to easily incline or pivot the side wall 17, a bearing 37 is provided about which the wall 17*b* of the side wall 17 is rotatable or pivotable in order to incline the side wall 17. As the hinge pin 37 is associated with the wall 17*b* in the exemplary embodiment, the distance between the underside of the wall 17*a* and the slide 14 varies during rotation or pivoting about the hinge pin 37, so that there may be a risk of concrete 6 escaping through the gap which is formed. For this purpose, the extension sheet 36 is provided, which can be extended or retracted as required via an operating element 38 (illustrated in FIG. 2) at the underside of the wall 17*b* in order to compensate for a gap which is formed as a result of the pivoting.

Alternatively, the hinge pin 37 can also be associated with the wall 17*a*.

The basic principle of the device according to the invention and the method according to the invention is apparent from FIGS. 1, 2, 5 and 6 viewed in conjunction with one another. In order to apply a facing layer of colored concrete for forming an upper side of a paving stone, provision is in this case made for the colored concrete to be introduced into the mold 4 from the storage container 7. The facing layer is in this case formed by the various dyed layers 9, 10, 11, 12 and 13. The layers are in this case stored layered one over another in the storage container 7 and can be introduced there in any desired manner, preferably using the guide sheet 31. As may be seen from FIG. 5, at least a first partial amount of the layers 9, 10, 11, 12 and 13 is dispensed from the storage container 7 as a result of the fact that the dispensing openings 18 in the side wall 17 are opened. Thus, a first partial amount of the layers 9, 10, 11, 12 and 13 falls onto the closure member 16 of the dispensing unit 15 in thoroughly blended form. Once a first partial amount has been supplied to the closure member 16 in thoroughly blended form, the process can be repeated by way of a cyclical opening and closing of the dispensing openings 18 by the dispensing means 19. As soon as this is desired or sufficient material no longer adjoins the side wall 17 provided with the dispensing openings 18, the slide 14 can be opened, such as is illustrated in FIG. 6, preferably continuously or step by step, so that partial portions of the layers 9, 10, 11, 12 and 13 break off and fall downward.

It is in keeping with the basic idea of the invention that any desired block bodies made of concrete materials, for example apart from paving stones and building blocks also plates, split blocks, veneer blocks or the like, can be provided with a colored, in particular marbled concrete material facing layer or facing layer displaying a color mix in accordance with the method and using the device.

The solution according to the invention also allows concrete blocks displaying a visual strip effect to be produced by way of a suitable control of the slide 14 and/or the dispensing openings.

It is also possible to use the method and the device in the case of any type and shape of block bodies formed entirely from colored concrete materials. Furthermore, provision may also be made to dispense not only a partial amount, but the entire contents of the receiving space 8 through the dispensing openings 18.

In a particularly simple configuration, the dispensing means 18 for opening and closing may also be relinquished or the dispensing means 19 can keep the size of passage of the dispensing openings constant. This also improves blending over the prior art. However, the result is not as advantageous as when the dispensing means ensure opening and closing of the dispensing openings. However, the invention is also intended to include this variant.

The invention claimed is:

1. A device for producing concrete building blocks, comprising:

a storage container having a main body which defines an internal cavity, and wherein the storage container has an upper, intake end, and an opposite, and lower discharge end, and wherein the storage container is additionally defined by at least one sidewall which has a vertically extending dispensing opening formed therein, and wherein the at least one sidewall is inclined in relation to a vertical plane such that a portion of the sidewall which positioned adjacent to the intake end of the storage container overhangs a portion of the sidewall which is positioned adjacent to the discharge end of the storage container, and wherein the storage container is further defined by a moveable floor which is located at the lower discharge end of the storage container;

a source of flowable concrete supplied to the internal cavity of the storage container, and wherein the source of concrete includes predetermined discrete layers of flowable concrete having different colors, and wherein the source of concrete is introduced at the intake end of the storage container, and moves under the influence of gravity in the direction of the lower discharge end of the storage container;

a dispensing means cooperating with the storage container, and which further is operable to selectively, open and close the dispensing opening, and wherein a partial amount of each of the respective predetermined, discrete and differently colored layers of the source of concrete, under the influence of gravity, respectively move, through the dispensing opening, when the dispensing means opens the dispensing open, and wherein the partial amounts of the predetermined, and discrete layers of concrete which have moved through the dispensing opening flowably move together, and then gravitationally mixes with each other so as to then form a resulting flowable concrete mixture having a predetermined color, and which moves gravitationally, downwardly relative to the storage container; and a downstream release device positioned in gravity receiving relation relative to the resulting flowable concrete mixture having the predetermined color, and wherein the downstream release device is operable to selectively release predetermined amounts of the resulting, flowable concrete mixture.

2. A device as claimed in claim 1, and wherein the inclination of the at least one sidewall is adjustable.

3. A device as claimed in claim 1, and wherein the dispensing means is operable to adjust a size of the dispensing opening.

4. A device as claimed in claim 1, and wherein the dispensing means further includes at least one projection which engages the predetermined discrete layers of the flowable concrete which are located adjacent to the dispensing means, and which further, during operation of the dispensing means, causes the predetermined discrete layers of the flowable concrete to loosen and pass through the dispensing opening.

5. A device as claimed in claim 1, and wherein the moveable floor is horizontally oriented, and wherein a movement of the moveable floor allows a portion of each of the predetermined discrete layers of the flowable concrete received within the storage container to move downwardly, together, and under the influence of gravity, and wherein the portions of each of the predetermined discrete concrete layers which move downwardly, together, mix with each other while moving downwardly so as to form a resulting flowable concrete mixture having a predetermined color, and which further travels, under the influence of gravity, and in the direction of the downstream release device.

* * * * *